US006307522B1

(12) United States Patent
Alexanian

(10) Patent No.: US 6,307,522 B1
(45) Date of Patent: Oct. 23, 2001

(54) FOLDED OPTICS ANTENNA

(75) Inventor: Angelos Alexanian, Somerville, MA (US)

(73) Assignee: Tyco Electronics Corporation, Wilmington, DE (US)

( * ) Notice: Subject to any disclaimer, the term of this patent is extended or adjusted under 35 U.S.C. 154(b) by 0 days.

(21) Appl. No.: 09/501,864

(22) Filed: Feb. 10, 2000

Related U.S. Application Data

(60) Provisional application No. 60/119,540, filed on Feb. 10, 1999.

(51) Int. Cl.[7] ..... H01Q 19/00

(52) U.S. Cl. ..... 343/781 CA; 343/755; 343/756; 343/757

(58) Field of Search ..... 343/781 CA, 781 P, 343/781 R, 754, 755, 756, 757, 779, 872, 909

(56) References Cited

U.S. PATENT DOCUMENTS

| | | | | |
|---|---|---|---|---|
| 3,771,160 | * | 11/1973 | Laverick | 343/756 |
| 4,504,835 | | 3/1985 | Howard et al. | 343/755 |
| 4,509,055 | | 4/1985 | Fassett | 343/754 |
| 4,574,287 | | 3/1986 | Waters | 343/756 |
| 4,599,623 | | 7/1986 | Havkin et al. | 343/756 |
| 4,743,907 | * | 5/1988 | Gellekink | 342/59 |
| 5,434,587 | | 7/1995 | Hannan | 343/909 |
| 5,455,589 | | 10/1995 | Huguenin et al. | 342/175 |
| 5,680,139 | | 10/1997 | Huguenin et al. | 342/175 |
| 6,150,991 | * | 11/2000 | Hulderman | 343/781 CA |

* cited by examiner

*Primary Examiner*—Don Wong
*Assistant Examiner*—Shih-Chao Chen

(57) ABSTRACT

An antenna (1) having an EM feed (6), a rear parabolic twist reflector (3) and a front transreflector (2). The transreflector is closer to the parabolic twist reflector than the focal point of the parabolic twist reflector, and the twist reflector is defined, mounted, or otherwise formed on a parabolic surface (17) of a base (13). The base is dimensioned and arranged to provide a foundation aligning an axis of the parabolic twist reflector with an axis of the antenna, and is further dimensioned and arranged to maintain substantial alignment of the feed and twist reflector with variations in ambient temperature that would otherwise produce at least one of warping and misalignment of the parabolic twist reflector in the absence of the base.

12 Claims, 2 Drawing Sheets

FOLDED OPTICS ANTENNA

This application claims benefit to 60/119,540 filed Feb. 10, 1999.

BACKGROUND OF THE INVENTION

1. Field of the Invention

The invention relates generally to compact solid state radar antenna structures, and more particularly, to microwave or millimeter wave radar antenna structures employing a folded optics path, a front transreflector, and a rear polarizing reflector.

2. Discussion of the Background Art

Solid state electronic microwave and millimeter wave radars generally contain three main components, a transceiver for generating and receiving electromagnetic radiation, an antenna for collimating and focusing the radiation, and a feed assembly for coupling the radiation from the transceiver to the antenna. In addition to collimating and focusing the emitted radiation, the antenna also receives and focuses the radiation reflected from detected objects, and provides it to the transceiver. To provide a compact structure, it is known to utilize a folded optics path, such that the longitudinal dimension of the antenna is less than the focal length of the lens alone. See, for example, U.S. Pat. No. 5,455,589 issued on Oct. 3, 1995 to Huguenin et al. and entitled "Compact Microwave and Millimeter Wave Radar". In the arrangement disclosed by Huguenin et al., a planoconvex lens is used to obtain radiation collimation.

In U.S. Pat. No. 4,599,623, issued to Havkin et al. on Jul. 8, 1986 and entitled "Polarizer Reflector and Reflecting Plate Scanning Antenna Including Same", there is disclosed an antenna which includes a front transreflector and a rear polarizer reflector, also known as a twist reflector. The transreflector is a polarizer, also known as an analyzer, that transmits radiation having a particular polarization, and that reflects radiation having a polarization orthogonal to the particular polarization. The front transreflector is a paraboloid, which transmits linear polarized, collimated electromagnetic (EM) radiation. In a receive mode, the paraboloid transreflector focuses linear polarized EM radiation. The twist reflector taught by Havkin et al. is flat and orthogonal to the axis of the paraboloid transreflector. As a consequence, the flat twist reflector arrangement reflects incident, linearly polarized EM radiation, and imparts a ninety degree twist such that the incident radiation is reflected with a polarization having an orthogonal ninety degree twist.

The antenna structure disclosed by Havkin et al. is a component of a microwave or millimeter wave EM radar in which the front transreflector is in front of an EM feed, at a focus of the antenna. The axis of the paraboloid transreflector and the axis of the orthogonal twist reflector must align to define properly the directions in which the antenna transmits and receives radiation. The need for this alignment gives rise to a problem in manufacturing. Specifically, alignment of the parabolic transreflector axis is made difficult because the orientation of the paraboloid changes as the transreflector undergoes thermal expansion and contraction with variations in temperature. Moreover, another disadvantage of the Havkin et al. arrangement resides in its required length. That is, the Havkin et al. structure requires that the EM feed be positioned at the actual focal length of the paraboloid, which limits any reduction of the actual length of the antenna.

Accordingly, there exists a need for a compact solid state radar antenna structure in which the possibility of improper or inefficient performance as a result of variations in temperature during manufacture and/or operation is reduced.

SUMMARY OF THE INVENTION

The aforementioned need is addressed, and an advance is made in the art, by an antenna which may be readily manufactured without substantial axial misalignment attributable to variations in temperature. To this end, the invention provides a base foundation to which is mounted both, an aligned EM feed, and an aligned and stationary twist reflector. The axis of the EM feed and the axis of the twist reflector are aligned, and remain substantially aligned, relative to the axis of the antenna despite variations in temperature.

In accordance with another aspect of the invention, a folded optics path is realized to provide radiation collimation to thereby advantageously reduce the length of the antenna. In contrast to Havkin et al., in which the antenna feed is positioned at the actual focal point of a collimating parabolic transreflector, the twist reflector of the inventive antenna disclosed herein is parabolic so that the transreflector is located substantially closer to the parabolic twist reflector than the focal point of the parabolic twist reflector. Accordingly, an antenna of substantially shorter length is realized. Moreover, the use of a parabolic twist reflector—as opposed to the planoconvex lens employed in other known arrangements—provides an additional benefit in that collimation is obtained without a lens to simplify both the mathematical optics and the structure of the antenna.

In accordance with yet another aspect of the invention, the aforementioned base foundation upon which the parabolic twist reflector is constructed is realized as non-paraboloid structure having a parabolic surface. The non-paraboloid base provides a foundation that preserves the alignment of the axis of the parabolic surface and the parabolic twist reflector relative to an axis of an antenna despite variations in temperature.

BRIEF DESCRIPTION OF THE DRAWINGS

The various aspects, features and advantages of the invention may be better understood by those skilled in the art by reference to the detailed description that follows, taken in conjunction with the drawings, in which.

DETAILED DESCRIPTION OF THE INVENTION

Figure 1:
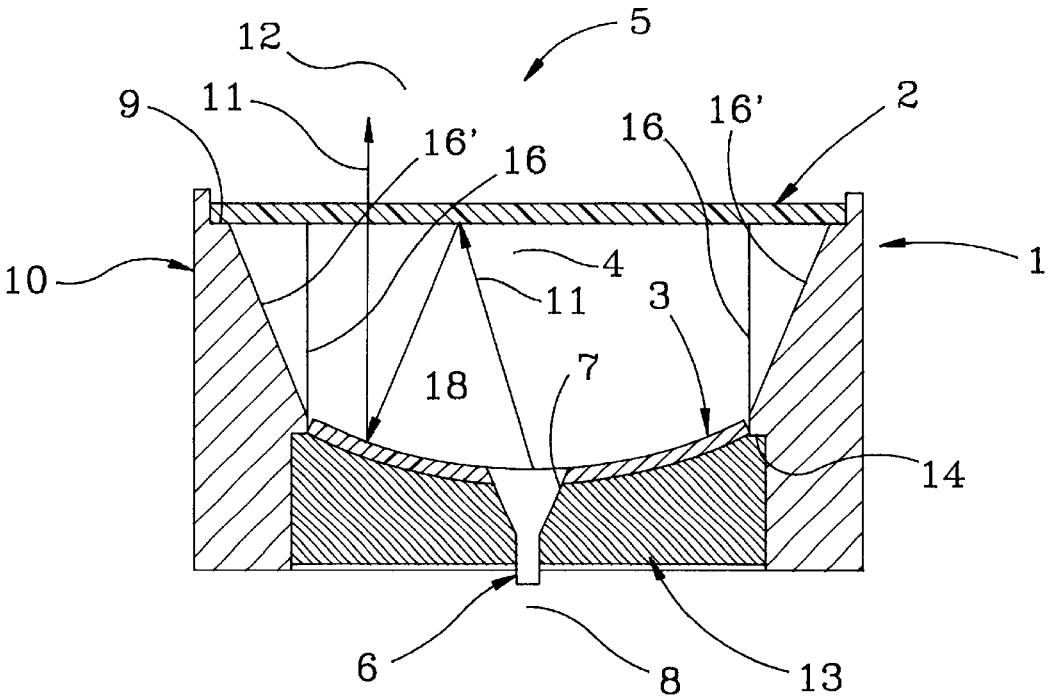
FIG. 1 is a section view of a folded optics antenna constructed in accordance with an illustrative embodiment of the present invention.

Initial reference is made to FIG. 1, in which there is shown a folded optics antenna arrangement 1 for use in a frequency modulated, continuous wave (FM-CW) radar. As will be readily appreciated by those skilled in the art, such a radar operates in alternating transmitting and receiving modes. For a transmitting mode, the radar emits EM radiation, for example, millimeter wave or microwave radiation. In a receiving mode, the radar receives EM radiation reflected from an object to determine the range, velocity and direction of movement of the object.

The antenna 1 comprises a flat, front transreflector 2 at a fixed distance from a rear twist reflector 3. The twist reflector 3 is parabolic in shape, and the axis 4 of parabolic twist reflector 3 extends from the apex of the parabolic shape to the focus 5 of the parabolic shape. Transreflector 2 is positioned transverse to the axis 4 of parabolic twist reflector 3. An EM feed 6 is positioned at an opening 7 through twist reflector 3. The axis 8 of EM feed 6 is aligned with the axis 4 of parabolic twist reflector 3, which defines the axis of transmission of far field focused, orthogonally polarized radiation that is transmitted by the antenna 1, and which further defines the principal direction from which reflected radiation is received by the antenna 1.

Transreflector 2 is also known as an analyzer that passes or transmits radiation having a particular, orthogonal polarization, and that reflects radiation having a different orthogonal polarization. During transmission, radiation is emanated by the EM feed 6, and is reflected by transreflector 2 toward twist reflector 3. The twist reflector 3 reflects incident radiation, imparting a 90 degree, such that reflected radiation is imparted with an orthogonal polarity relative to that of the incident radiation. Thus, the polarity of the incident radiation is reflected with a 90 degree twist, when reflected by twist reflector 3. The radiation reflected by parabolic twist reflector 3 has a polarity that is passed unaffected by transreflector 2. In addition, antenna 1 collimates radiation imaged at the far field upon reflection by parabolic twist reflector 3, which radiation has an orthogonal polarity that is passed unaffected by transreflector 2.

Figure 2:
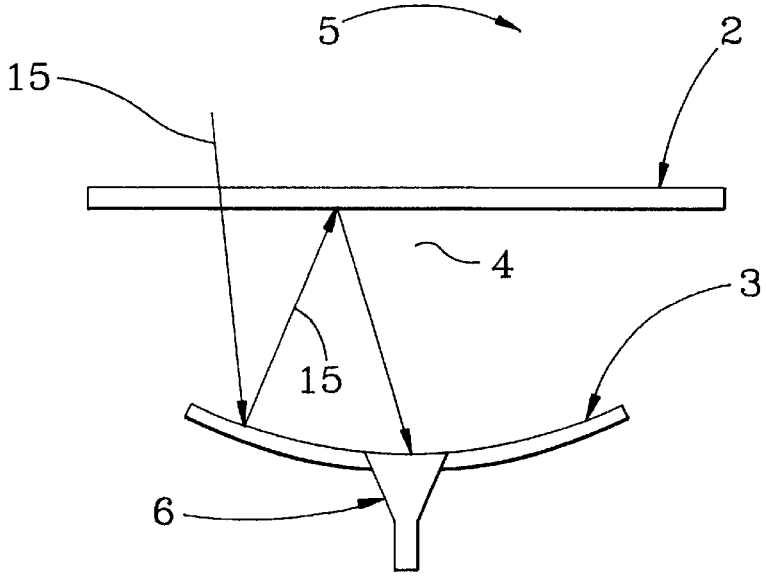
FIG. 2 is a diagrammatic view of the folded optics antenna as shown in FIG. 1.

With reference to FIG. 2, it will be seen that transreflector 2 is mounted against an interior shoulder 9 of a hollow housing 10, which positions the flat transreflector 2 at a fixed distance from parabolic twist reflector 3. An emanated ray 11 from the EM feed 6 is reflected rearward by transreflector 2, and is incident on parabolic twist reflector 3. The incident ray 11 is reflected by the parabolic transreflector 2 with an imparted 90 degree polarity twist and is focused at the far field. The reflected ray 11 having the proper polarity is passed by the flat transreflector 2.

The antenna 1 utilizes folded optics principles. Accordingly, transreflector 2 is positioned closer to parabolic twist reflector 3 than the actual focus 5 of parabolic twist reflector 3. The folded optics antenna 1 is more compact than an equivalent antenna structure, as shown in phantom outline, wherein, EM feed 6 is positioned at the actual focus of a parabolic transreflector that is shown in phantom outline as a virtual parabolic transreflector 12. Thus, antenna 1 is constructed according to folded optics principles to provide a compact antenna in which the EM feed 6 need not be positioned at the actual focus of the antenna 1 (i.e., the actual focus 5 of parabolic twist reflector 3).

Returning briefly to FIG. 1, it will be seen that twist reflector 3 is mounted, constructed, or otherwise defined on a base 13 of substantial thickness which, in turn, is mounted against an interior shoulder 14 of the hollow housing 10. The interior shoulder 14 is precisely located on the housing 10 relative to the interior shoulder 9 that precisely locates transreflector 2. Accurate positioning of transreflector 2 relative to parabolic twist reflector 3 is important in order to assure accurate focus of received radiation at EM feed 6. As shown in FIG. 2, a ray 15 of received radiation is passed by transreflector 2, and is reflected by twist reflector 3 with a 90 degree twist, such that the reflected ray 15 has an orthogonal polarity that is reflected rearward by transreflector 2 to EM feed 6.

Returning once again to FIG. 1, it will be seen that interior surface 16 of hollow housing 10 can be parallel to the axis 4 of parabolic twist reflector 3. Alternatively, interior surface 16 may diverge at 16', relative to the axis 4 of parabolic twist reflector 3, such that off-axis rays 15 (FIG. 2) of received radiation will be passed by the transreflector to become incident on twist reflector 3.

Figure 3:
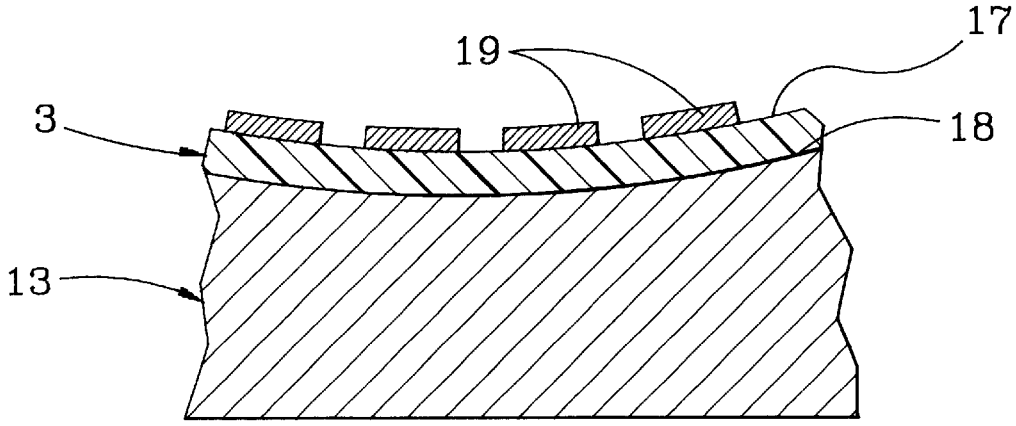
FIG. 3 is a fragmentary section view of a parabolic twist reflector as shown in FIG. 1.

With reference now to FIG. 3, the construction of twist reflector 3 will be described in greater detail. In accordance with the present invention, twist reflector 3 is constructed on a base 13 which provides stability and preserves alignment despite variations in temperature. Accordingly, it is desirable that the base be constructed of a material which has a relatively low coefficient of thermal expansion and which is sufficiently thick and of sufficient bulk as to not be subject to undesirable deformation (elongation or flattening). To the extent that the material selected for the base has the ability to reliably return to its original shape when a temperature cycle has concluded, however, it will be understood that some tendency to expand or contract with variations in temperature may be tolerated. For ease of manufacturing, it is contemplated by the inventor herein that a wide variety of metals and metal alloys are suitable for fabrication of the base. However, other materials having the material properties discussed above might also be utilized.

In any event and with continued reference to FIG. 3, twist reflector 3 may be formed by depositing a continuous film 17 on the parabolic surface 18 defined in an electrically conductive base 13. The dielectric film has thickness of about one quarter wavelength (□/4)—or uneven multiples of □/4—of the EM radiation emanated by EM feed 6. By way of illustrative example, dielectric film 17 may be deposited by electrophoretic deposition. A metal grid 19 as a polarizer may be configured as a laminate on the dielectric film 17. For example, metal grid 19 may formed by electroless deposition, followed by electrodeposition of copper, followed in turn by selective etching away portions of the copper to form the metal grid 19.

Figure 3A:
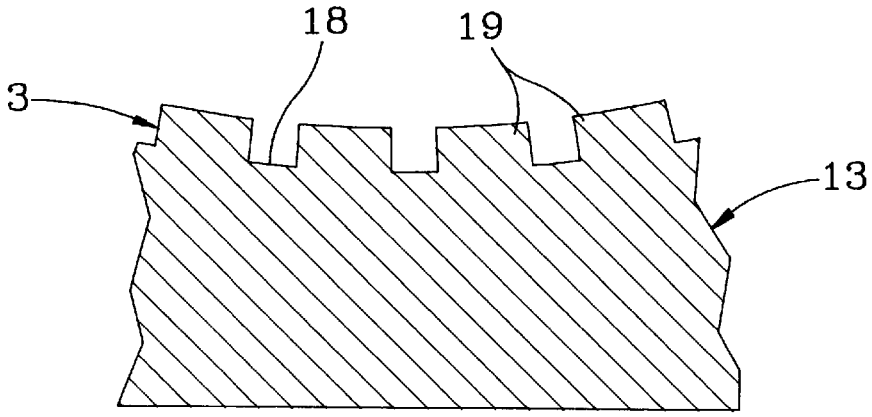
FIG. 3A is a view similar to FIG. 3, depicting a modified embodiment of twist reflector constructed in accordance with the present invention.

It will be readily understood by those skilled in the art, however, that the polarizer can be formed by alternate structures. For example, and with particular reference to the alternative embodiment depicted in FIG. 3A, it will be appreciated that the polarizer may be formed directly by machining or selectively etching the parabolic surface 18 of the base 13 to form the metal grid 19. The grid 19 extends as projections in air, outwardly from parabolic surface 18, with the aforementioned thickness of □/4 (or odd multiple thereof) of the radiated EM energy emanated by EM feed 6.

As mentioned earlier, the parabolic twist reflector 3 is constructed on a parabolic surface 18 that is recessed in a non-paraboloid base 13. The non-paraboloid base 13 has a substantial non-paraboloid thickness that provides a foundation which maintains alignment of the common axis 4 of parabolic surface 18 and parabolic twist reflector 3 relative to the axis of the antenna 1. Accordingly, the parabolic twist reflector 3 avoids the disadvantages of prior reflectors that are of paraboloid shapes. Paraboloid shapes are subject to axial misalignment and warpage of their shapes/reflective surfaces with changes in temperature. Thus, heretofore during manufacture of prior antennas, the alignment and shape of paraboloid shaped reflectors has heretofore been disadvantageously effected by temperature conditions. From the foregoing discussion, it should be readily appreciated by those skilled in the art that such temperature dependence is avoided by providing a parabolic twist reflector 3 on a parabolic surface 18 of a non-paraboloid base such that axial alignment is maintained despite temperature fluctuations. Moreover, warpage of the parabolic twist reflector 3 with variations in temperature is also avoided. For example, the base 13 may be configured as a solid block with the parabolic surface 18 defined as a recess on one surface thereof.

Returning once more to FIG. 1, the EM feed 6 is rigidly embedded in the opening 7 that extends through the substantial thickness of base 13. Such a thickness assures accurate alignment of the embedded EM feed 6 along the axis of the antenna 1. Further, such accurate alignment, as noted earlier, is preserved despite variations in temperature.

Figure 4:
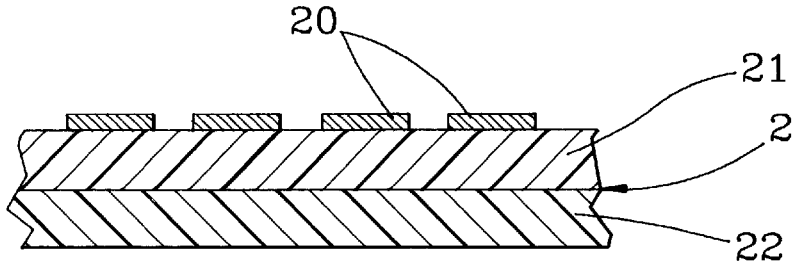
FIG. 4 is a fragmentary section view of a transreflector of the illustrative embodiment of an antenna depicted in FIG. 1.

With reference now to FIG. 4, it will be seen that transreflector 2 has a thin metal grid 20 formed on a dielectric layer 21. The dielectric layer 21 has a thickness of about one-half the wavelength ($\lambda/2$) (or multiples thereof), of the EM radiation emitted by the EM feed 6. According to one embodiment, the dielectric layer 21 is of sufficient stiffness to be self-supporting, and that stays flat with variations in temperature. According to another embodiment, additional stiffness is provided by having the dielectric layer 21 supported against a stiff dielectric layer 22—the thickness of which being about about one-half the wavelength ($\lambda/2$) (or multiples thereof), of the EM radiation emitted by the EM feed 6—that stays flat with variations in temperature. Whereas, a prior known paraboloid shaped transreflector will undergo axial misalignment and warpage of its shape with variations in temperature, the flat transreflector 2 (FIGS. 1, 4) maintains a precise alignment relative to the axis 5 of the antenna 1, despite variations in temperature. Further, the flat transreflector 2 maintains its flat shape with variations in temperature.

While the invention has been shown with respect to a preferred embodiment of the invention, the specific configurations that have been illustrated and described in detail herein are merely exemplary. Various modifications, equivalents and alternatives are contemplated by the inventor and should be considered to fall within the scope of the appended claims.

What is claimed is:

1. A folded optics antenna, comprising:

a base having a front facing parabolic surface;

an electromagnetic (EM) feed mounted on said base; and a parabolic twist reflector defined on said front facing parabolic surface, said base being dimensioned and arranged to provide a foundation aligning an axis of said parabolic twist reflector with an axis of the antenna;

wherein said base is further dimensioned and arranged to maintain the shape of said front facing parabolic surface and to maintain substantial alignment of said feed and said twist reflector with variations in ambient temperature which would otherwise produce at least one of warping and misalignment of said parabolic twist reflector in the absence of said base.

2. The antenna of claim 1, wherein said base has a non-paraboloid shape.

3. The antenna of claim 1, further including a front transreflector disposed closer to said parabolic twist reflector than a focal point of said parabolic twist reflector.

4. The antenna of claim 3, wherein said front transreflector is flat.

5. The antenna of claim 1, wherein said base defines an opening dimensioned and arranged to receive the feed and wherein the feed is embedded in said opening.

6. The antenna of claim 1, wherein the twist reflector is formed by a dielectric layer on said front facing parabolic surface.

7. The antenna of claim 6, wherein the twist reflector further includes an electrically conductive grid laminate on said dielectric layer.

8. A folded optics antenna, comprising:

a base;

an electromagnetic (EM) feed mounted on said base;

a parabolic twist reflector mounted on said base, said base being dimensioned and arranged to provide a foundation aligning an axis of said parabolic twist reflector with an axis of the antenna; and a front transreflector disposed closer to the parabolic twist reflector than a focal point of the parabolic twist reflector.

9. The antenna of claim 8, wherein the transreflector is flat.

10. The antenna of claim 8, wherein the base defines a front facing parabolic surface dimensioned and arranged to accommodate the twist reflector, and wherein the twist reflector is mounted on said front facing parabolic surface.

11. The antenna of claim 8, wherein the base is formed from an electrically conductive metal or metallic alloy.

12. The antenna of claim 8, wherein the base has a non-paraboloid shape.

* * * * *